US005716205A

United States Patent [19]

Tratz

[11] Patent Number: 5,716,205

[45] Date of Patent: Feb. 10, 1998

[54] ROTATABLE HEATING CHAMBER FOR SOLID MATERIAL

[75] Inventor: Herbert Tratz, Ottensoos, Germany

[73] Assignee: Siemens Aktiengesellschaft, Munich, Germany

[21] Appl. No.: 610,520

[22] Filed: Mar. 4, 1996

[30] Foreign Application Priority Data

Sep. 3, 1993 [DE] Germany ..... 43 29 871.0
Aug. 23, 1994 [DE] Germany ..... 44 29 897.8

[51] Int. Cl.[6] ..... F27B 7/10

[52] U.S. Cl. ..... 432/103; 432/105; 432/107; 432/114

[58] Field of Search ..... 432/103, 105, 432/107, 114

[56] References Cited

U.S. PATENT DOCUMENTS 3,975,002 8/1976 Mendenhall ..... 432/112
5,154,648 10/1992 Buckshaw .

FOREIGN PATENT DOCUMENTS 157330 3/1985 European Pat. Off. .
0157330 10/1985 European Pat. Off. .
0302310 2/1989 European Pat. Off. .
0565954 10/1993 European Pat. Off. .
1176841 4/1959 France .
3702318 1/1988 Germany .

*Primary Examiner*—Henry A. Bennett
*Assistant Examiner*—Gregory Wilson
*Attorney, Agent, or Firm*—Herbert L. Lerner; Laurence A. Greenberg

[57] ABSTRACT

A heating chamber for solid material, preferably a low-temperature carbonization drum for waste, is rotatable about its longitudinal axis and is equipped with a number of heating tubes that are disposed in an interior space and are aligned approximately parallel to one another. In order to ensure that only fine material can collect between the heating tubes and the inner wall surface of the heating chamber, the heating tubes, as viewed in cross-section, are disposed in a virtually closed row along the wall. Dummy tubes which are preferably easy to remove and preferably have the same diameter as the heating tubes, are located in this row, which may be circular.

12 Claims, 2 Drawing Sheets

ROTATABLE HEATING CHAMBER FOR SOLID MATERIAL

CROSS-REFERENCE TO RELATED APPLICATION

This application is a Continuation of International Application Ser. No. PCT/DE94/00996 , filed Aug. 30, 1994.

BACKGROUND OF THE INVENTION

1. Field of the Invention

The invention relates to a heating chamber for solid material being rotatable about its longitudinal axis, and preferably to a low-temperature carbonization drum for waste, having a number of heating tubes being accommodated in an interior space and being aligned approximately parallel to one another.

The heating chamber is preferably used as a low-temperature carbonization drum for waste for the purpose of thermal waste disposal, preferably according to the low-temperature carbonization combustion process.

In the field of waste disposal, the so-called low-temperature carbonization combustion process has become known. The process and a plant operating according to that process for thermal waste disposal are described, for example, in published European Patent Application 0 302 310 A1, corresponding to U.S. Pat. No. 4,878,440 . The plant for thermal waste disposal according to the low-temperature carbonization combustion process contains a low-temperature carbonization chamber (pyrolysis reactor) and a high-temperature combustion chamber, as essential components. The low-temperature carbonization chamber converts the waste being fed in through a waste transport device into low-temperature carbonization gases and pyrolysis residue. The low-temperature carbonization gases and the pyrolysis residue are then fed, after suitable preparation, to a burner of the high-temperature combustion chamber. A molten slag which is removed through an outlet and is present in glass-like form after cooling, is formed in the high-temperature combustion chamber. Flue gas being formed is conveyed through a flue gas line to a stack as an outlet. The flue gas line is preferably fitted internally with a waste heat boiler as a cooling device, a dust filter system and a flue gas purification system.

The low-temperature carbonization chamber (pyrolysis reactor) being used is generally a rotating, relatively long low-temperature carbonization drum which has a multiplicity of parallel heating tubes in its interior on which the waste is heated largely to the exclusion of air. The low-temperature carbonization drum rotates about its longitudinal axis. The longitudinal axis is preferably somewhat inclined to the horizontal so that the solid low-temperature carbonization product can collect at the outlet of the low-temperature carbonization drum and from there can be discharged through a discharge pipe. During rotation the waste is lifted up by the heating tubes and falls down again. In that way and through the use of waste moving along behind, the solid material (dust, lumps of carbon (coke), bricks, parts of bottles, metal, ceramic, etc.) is transported in the direction of a discharge opening of the low-temperature carbonization drum.

In such a heating chamber, in particular in the low-temperature carbonization of waste, it is important that as large as possible a heating area is made available through the use of the individual heating tubes. In order to accomplish that, the prior art provided rows of individual heating tubes which, as viewed in the cross-section of the low-temperature carbonization drum, extended, preferably linearly, from the inner wall surface of the low-temperature carbonization drum in the direction of the interior space. In addition, in the prior art heating tubes ("peripheral heating tubes") were occasionally disposed on and along the inner wall surface, although only if required. In no case was a virtually closed tube circuit, i.e. a tube circuit without gaps, heretofore provided. The peripheral configuration of the, sometimes irregularly spaced, heating tubes was able to have, for example, a gap at the point at which there was an opportunity for entering the low-temperature carbonization drum, for example by provision of a manhole. In addition, it should be noted that the spacing between two adjacent heating tubes on the inner wall surface was heretofore virtually as desired. In other words, the spacing was determined by the construction and was a function of the heating area required.

The result of that irregular configuration of the heating tubes on the inner wall surface, was stressing of the low-temperature carbonization drum wall by falling pieces of waste. Furthermore, metal pieces or other lumps of solid were able to jam between the drum wall and the directly adjacent heating tubes. That reduced the available heating area.

SUMMARY OF THE INVENTION

It is accordingly an object of the invention to provide a rotatable heating chamber for solid material, which overcomes the hereinafore-mentioned disadvantages of the heretofore-known devices of this general type and in which there is a sufficiently large heating area in the form of heating tubes available in the vicinity of the inner wall surface of the heating chamber for the heating or pyrolysis of the waste being fed in. In other words: the danger of jamming of metal pieces or other solid lumps should be greatly reduced so that the side of the individual heating tubes facing the inner wall surface of the heating chamber can be optimally utilized for heat transfer.

With the foregoing and other objects in view there is provided, in accordance with the invention, a heating chamber for solid material, preferably a low-temperature carbonization drum for waste, comprising a wall defining an interior space and a longitudinal axis about which the heating chamber is rotatable; and a number of heating tubes being disposed along the wall in the interior space as seen in cross section, the heating tubes being aligned approximately parallel to one another and having a given diameter, the heating tubes being spaced apart from each other by a spacing being less than half of the given diameter, and the heating tubes being spaced apart from the wall by a spacing being less than half of the given diameter.

The invention is accordingly based on the idea that the availability of a large heating area can be ensured by the individual heating tubes being disposed as densely as possible on the inner wall surface. In other words: to prevent the lumps mentioned above from being able to jam in the intermediate space, the heating tubes on the inner wall surface of the drum should form a virtually closed jacket, i.e. in the case of a cylindrical low-temperature carbonization drum, a circle of tubes. The spacings between the individual heating tubes in this case should be selected so as to be as narrow as possible.

It should be emphasized once more that: the provision of a virtually closed, for example circular, bundle ensures that no coarse material can fall through the intermediate spaces between the individual heating tubes onto the inner wall surface of the heating chamber and erode or stress the latter. This makes certain that only the fine waste material falls through these gaps onto the inner wall surface of the heating chamber. This also ensures that no metal waste pieces or other lumps of solid can jam between the individual heating tubes and the inner wall surface. Thus only the fine material and the gas present in the interior space are in thermal contact with the side of the individual heating tubes facing the inner wall surface.

Thus, in summary, the essential advantages are that only fine waste material can fall onto the inner wall surface of the heating chamber and that this inner wall surface is virtually not mechanically stressed. Furthermore, in a pyrolysis reactor or a low-temperature carbonization drum, good heat exchange is achieved from the heating tubes to the gas atmosphere and to the layer of fine material. The heat which is radiated radially outwards from the heating tubes is thus utilized very well.

In accordance with another feature of the invention, the heating tubes located on the inner wall surface of the heating chamber can be protected from falling coarse material by shields made of a resistant material. These are preferably semicylindrical shields. Such protection can also be provided for heating tubes which extend in straight or curved lines (viewed in cross-section) into the interior of the heating chamber.

In order to enter the heating chamber, a manhole will generally be provided. In accordance with a further feature of the invention, preference is given to providing dummies in the row of heating tubes, if desired in the region of such a manhole. These dummy tubes are tubes through which no heating gas flows. They are preferably disposed so as to be easy to remove. This enables the row of heating tubes on the inner wall surface to be closed during operation of the heating chamber, while it is interrupted by removal of the dummy tubes in the region of the manhole during entry of personnel.

As mentioned above, the spacing between two adjacent peripheral heating tubes and/or dummy tubes should preferably be less than half the tube diameter. In accordance with an added feature of the invention, the spacing is in the range of from 20 to 40 mm, which is structurally possible and very suitable.

In accordance with an additional feature of the invention, the dummy tubes should have the same diameter as the peripheral heating tubes disposed on the inner wall surface.

In accordance with yet another feature of the invention, the spacing of the (preferably closed) circle of tubes from the inner wall surface of the heating chamber should be as small as possible. It will generally be determined by structural requirements, for example by the fixing of the heating tubes and/or dummy tubes to end plates. Usually this spacing can be in the range from 20 to 40 mm.

In accordance with yet a further feature of the invention, there are provided additional heating tubes in the interior space being disposed in non-radial rows, each of the rows beginning a short distance from the wall and extending into the interior space.

In accordance with yet an added feature of the invention, the heating chamber rotates in a given direction, and each of the rows of the additional heating tubes is curved counter to the given direction of rotation, as seen from the wall into the interior.

In accordance with yet an additional feature of the invention, the heating chamber rotates in a given direction, and each of the rows of the additional heating tubes is disposed along a straight line and is inclined counter to the given direction of rotation, as seen from the wall into the interior.

In accordance with a concomitant feature of the invention, the rows include longer and shorter non-radial rows in the interior space.

Other features which are considered as characteristic for the invention are set forth in the appended claims.

Although the invention is illustrated and described herein as embodied in a rotatable heating chamber for solid material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
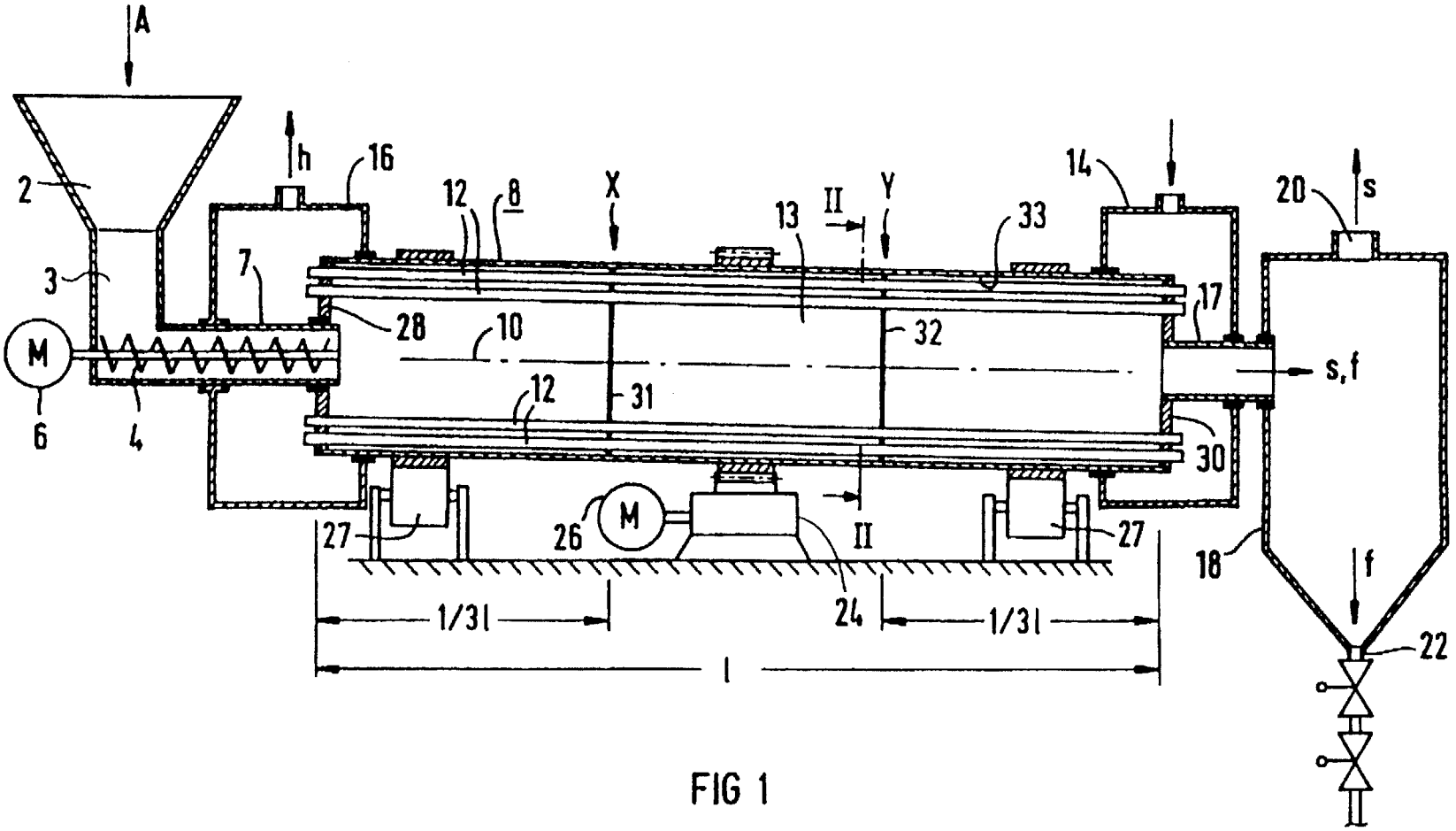
FIG. 1 is a diagrammatic, longitudinal-sectional view of a low-temperature carbonization plant having a low-temperature carbonization chamber for waste, which can be used for the purposes of the low-temperature carbonization combustion process.

Referring now to the figures of the drawing in detail and first, particularly, to FIG. 1 thereof, it is seen that solid waste A is introduced centrally into a pyrolysis reactor or low-temperature carbonization chamber 8 through a supply or feed device 2 having a vertical chute 3, and through a worm or screw 4 which is driven by a motor 6 and is disposed in a feed tube 7. In the embodiment example, the low-temperature carbonization chamber 8 is an internally heatable low-temperature carbonization or pyrolysis drum which is rotatable about its longitudinal axis 10, which can have a length of from 15 to 30 m, which operates at from 300 to 600° C., which is operated largely to the exclusion of oxygen and which produces, besides volatile low-temperature carbonization gas s, a largely solid pyrolysis residue f. The low-temperature carbonization drum 8 has a multiplicity (for example from 50 to 200) of internal heating tubes 12 aligned parallel to one another in an interior space 13, although only four of these tubes are shown in FIG. 1. An inlet for heating gas h in the form of a static, sealed heating-gas inlet chamber 14 is disposed at a right-end or "hot" end, and an outlet for the heating gas h in the form of a static, sealed heating gas outlet chamber 16 is disposed at the left-end or "cold" end. The longitudinal axis 10 of the low-temperature carbonization drum 8 is preferably inclined to the horizontal so that the outlet at the "hot" end at right lies at a lower level than the inlet for the waste A shown at left. The low-temperature carbonization drum 8 is preferably maintained at a slightly lower pressure than the surroundings.

An outlet or discharge end of the pyrolysis drum 8 is connected through a corotating central discharge tube 17 to a discharge device 18 being disposed downstream and having a low-temperature carbonization gas vent nozzle 20 for the outlet of the low-temperature carbonization gas s and a pyrolysis residue outlet 22 for the discharge of the solid pyrolysis residue f. A low-temperature carbonization gas line fitted to the low-temperature carbonization gas vent nozzle 20 is connected to the burner of a non-illustrated high-temperature combustion chamber.

The rotation of the low-temperature carbonization drum 8 about its longitudinal axis 10 is effected by a drive 24 in the form of a gear box or transmission which is connected to a motor 26. The drives 24, 26 act, for example, on a gear ring which is fixed to the periphery of the low-temperature carbonization drum 8. Bearings of the low-temperature carbonization drum 8 are indicated by reference numeral 27.

It is clear from FIG. 1 that each of the heating tubes 12 has one end fixed to a first end plate 28 and another end fixed to a second end plate 30. The fixation to the end plates 28, 30 is constructed in such a way that the heating tubes 12 can preferably be easily replaced. The end of each of the heating tubes 12 projects through an opening leading from the interior space 13 towards the left into the outlet chamber 16 or towards the right into the inlet chamber 14. In each case the axis of the heating tubes 12 is aligned perpendicular to the surface of the end plates 28, 30. In the construction shown, it is noted that the individual heating tubes 12 are highly stressed thermally and mechanically and that the end plates 28, 30, which can also be described as tube plates or drum tube sheets, also rotate about the longitudinal axis 10 of the low-temperature carbonization drum 8.

Two support locations X, Y are disposed between the end plates 28, 30 for supporting the heating tubes 12 (which otherwise might possibly sag). As viewed in the direction of transport of the waste A, the first support location X is about one third (⅓l) and the second support location Y is about two thirds (⅔l) of the way along a total length 1 of the low-temperature carbonization drum 8. In this case bearer or support brackets 31, 32 are provided in the form of rounded perforated plates of metal, for example of steel. The support brackets are fixed to an inner wall surface 33.

Figure 2:
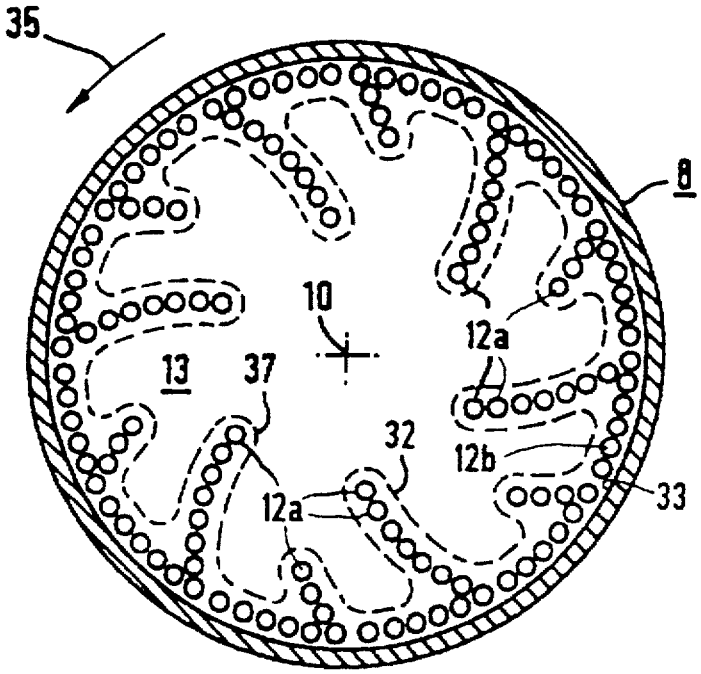
FIG. 2 is cross-sectional view of a first configuration of heating tubes in the low-temperature carbonization drum of FIG. 1.
Figure 3:
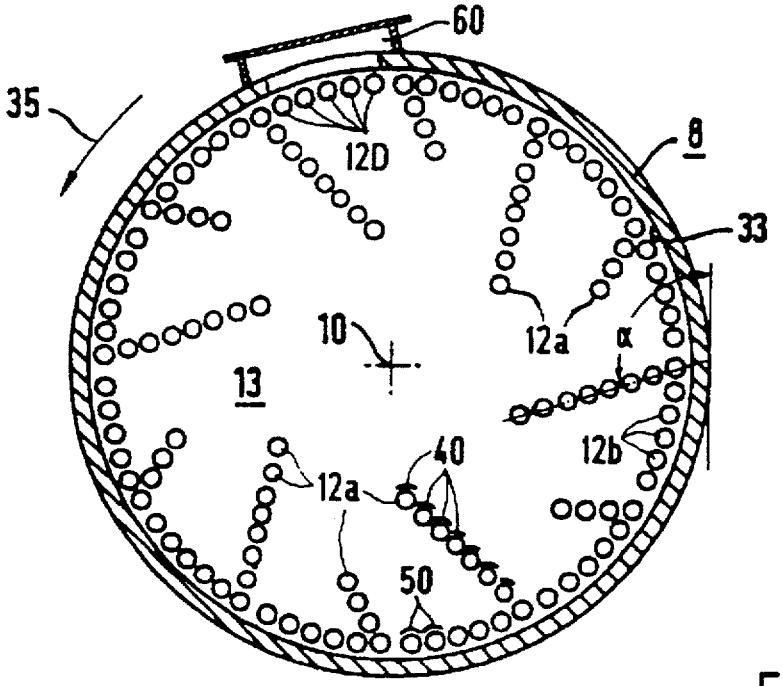
FIG. 3 is a cross-sectional view of a second configuration of heating tubes in the low-temperature carbonization drum of FIG. 1.

The heating tubes 12 can be disposed in a configuration as shown in both FIG. 2 and FIG. 3. According to these configurations, there is a multiplicity of peripherally disposed heating tubes **12*b* and a multiplicity of inner heating tubes 12*a* disposed along curved or straight lines for heating the waste lying closer to the center. The curvature depends on the rotation of the low-temperature carbonization drum 8, which is indicated by an arrow 35. It is clear from FIG. 2 that six shorter and six longer non-radial rows of inner heating tubes 12*a* are provided. The peripheral heating tubes 12*b* are located in a virtually gap-free or closed circle close to the inner wall surface 33 of the low-temperature carbonization drum 8**.

The non-radial rows each begin, as shown in FIGS. 2 and 3, in the vicinity of the inner wall surface 33. It is of particular importance to note that they are curved as seen in FIG. 2 or inclined as seen in FIG. 3, counter to the direction of rotation 35. This ensures that during rotation about the longitudinal axis 10 waste A collecting on the heating tubes **12*a* , 12*b*** can fall off soon and thus not fall from any appreciable height. This effectively reduces the danger of damage by lumps present in the waste A.

For clarification, FIG. 3 shows an obtuse angle α between the direction of the individual rows and the tangent at the wall of the low-temperature carbonization drum 8.

In order to achieve good low-temperature carbonization of the waste A, it is also provided that the mutual spacing of the individual heating tubes **12*a* be less than half the diameter of a heating tube 12*a* of the row in question. This also applies to the peripheral heating tubes 12*b***.

FIG. 3 shows protective shields 40 along a single linear row. The other linear rows will likewise be covered on the side facing the central axis 10 with such shields 40 made of resistant material, like the curved rows of the heating tubes **12*a* in FIG. 2. The same applies for shields 50 which can be provided for the peripheral heating tubes 12*b* in FIGS. 2 and 3. For clarity, only two of these shields 50 are shown in FIG. 3**.

FIG. 3 also shows that in the vicinity of a diagrammatically represented manhole 60, through which personnel can enter the interior space 13 during maintenance or repair work, the annular row of heating tubes **12*b* is completed by dummy tubes 12*D* of the same length and the same external diameter. These dummy tubes 12D are fixed to the end plates 28, 30 so as to be easy to detach. They are removed in the event of maintenance or repair. During operation, all of the tubes 12*b* , 12D ensure that only fine material can reach the inner wall surface 33. As viewed overall, the tubes 12*a* , 12D** are disposed closely spaced along a virtually gap-free closed circle.

I claim:

1. A heating chamber for solid waste material, comprising:

a wall defining an interior space and a longitudinal axis about which the heating chamber is rotatable; and a number of heating tubes being disposed along said wall in said interior space as seen in cross section of said interior space, said heating tubes being aligned approximately parallel to one another and having a given diameter, said heating tubes along said wall being spaced apart from each other by a spacing being less than half of said given diameter, said spacing being in a range of between 20 and 40 mm, and said heating tubes along said wall being spaced apart from said wall by a spacing being less than half of said given diameter for protecting said wall from being damaged by lumps of solid waste material when the heating chamber is rotated.

2. The heating chamber according to claim 1, wherein said spacing of said heating tubes from said wall is between 20 mm and 40 mm.

3. The heating chamber according to claim 1, including easily removable dummy tubes in place of some of said heating tubes.

4. The heating chamber according to claim 3, wherein said dummy tubes have the same diameter as said heating tubes.

5. The heating chamber according to claim 1, including additional heating tubes in said interior space being disposed in non-radial rows, each of said rows beginning a short distance from said wall and extending into said interior space.

6. The heating chamber according to claim 5, wherein the heating chamber rotates in a given direction, and each of said rows of said additional heating tubes is curved counter to said given direction of rotation, as seen from said wall into said interior.

7. The heating chamber according to claim 5, wherein the heating chamber rotates in a given direction, and each of said rows of said additional heating tubes is disposed along a straight line and is inclined counter to said given direction of rotation, as seen from said wall into said interior.

8. The heating chamber according to claim 5, wherein said rows include longer and shorter non-radial rows in said interior space.

9. The heating chamber according to claim 6, wherein said rows include longer and shorter non-radial rows in said interior space.

10. The heating chamber according to claim 7, wherein said rows include longer and shorter non-radial rows in said interior space.

11. A heating chamber for solid waste material, comprising:

a wall defining an interior space and a longitudinal axis about which the heating chamber is rotatable;

a number of heating tubes being disposed along said wall in said interior space as seen in cross section of said interior space, said heating tubes being aligned approximately parallel to one another and having a given diameter, said heating tubes being spaced apart from each other by a spacing being less than half of said given diameter, and said heating tubes being spaced apart from said wall by a spacing being less than half of said given diameter; and shields disposed on said heating tubes disposed along said wall for protection against damage.

12. A low-temperature carbonization drum for waste, comprising:

a wall defining an interior space and a longitudinal axis about which the heating chamber is rotatable; and a number of heating tubes being disposed along said wall in said interior space as seen in cross section of said interior space, said heating tubes being aligned approximately parallel to one another and having a given diameter, said heating tubes along said wall being spaced apart from each other by a spacing being less than half of said given diameter, said spacing being in a range of between 20 and 40 mm, and said heating tubes along said wall being spaced apart from said wall by a spacing being less than half of said given diameter for protecting said wall from being damaged by lumps of solid waste material when the heating chamber is rotated.

* * * * *

UNITED STATES PATENT AND TRADEMARK OFFICE
CERTIFICATE OF CORRECTION

PATENT NO : 5,716,205
DATED : February 10, 1998
INVENTOR(S): Herbert Tratz

It is certified that error appears in the above-identified patent and that said Letters Patent is hereby corrected as shown below:

On the title page:
Item [63] should read as follows:

Continuation of PCT/DE94/00996, August 30, 1994.

Signed and Sealed this

Twenty-eighth Day of July, 1998

*Attest:*

BRUCE LEHMAN

*Attesting Officer*

*Commissioner of Patents and Trademarks*